United States Patent [19]

Ebeling et al.

[11] 4,112,691

[45] Sep. 12, 1978

[54] RAIN WATER ROOF OUTLET OR SIMILAR FOR A BUILDING

[75] Inventors: Martti Olavi Aladar Ebeling; Risto Waldemar Lundén, both of Helsinki, Finland

[73] Assignee: Kontekla Oy., Helsinki, Finland

[21] Appl. No.: 808,348

[22] Filed: Jun. 20, 1977

[51] Int. Cl.[2] ..... E02B 5/08; E02B 9/04

[52] U.S. Cl. ..... 405/119; 52/12; 210/163

[58] Field of Search ..... 61/14, 15; 52/12, 16, 52/11; 210/163, 164, 165, 166, 460

[56] References Cited

U.S. PATENT DOCUMENTS

| | | | |
|---|---|---|---|
| 803,316 | 10/1905 | Vogel | 52/16 |
| 1,582,646 | 4/1926 | Flesch et al. | 210/166 |
| 2,568,521 | 9/1951 | Stauch, Sr. | 210/163 |

*Primary Examiner*—Jacob Shapiro

*Attorney, Agent, or Firm*—Cushman, Darby & Cushman

[57] ABSTRACT

A rain water roof outlet comprising a vertical pipe and a trough fixed to the upper end of said pipe. A lid is fastened in the trough above the inlet end of said pipe. The lid is larger than the inlet end of the pipe to cause water to flow radially in the trough to said inlet end and to prevent suction of air into the pipe when the water level in the trough is above said lid. The lid is closed except for a number of small holes extending through the lid. The total area of said holes is at the most 15% of the cross-sectional area of the vertical pipe so that the formation of an air whirl in the vertical pipe is prevented in spite of the air entering the inlet end of the pipe through said holes.

1 Claim, 2 Drawing Figures

RAIN WATER ROOF OUTLET OR SIMILAR FOR A BUILDING

Figure 1:
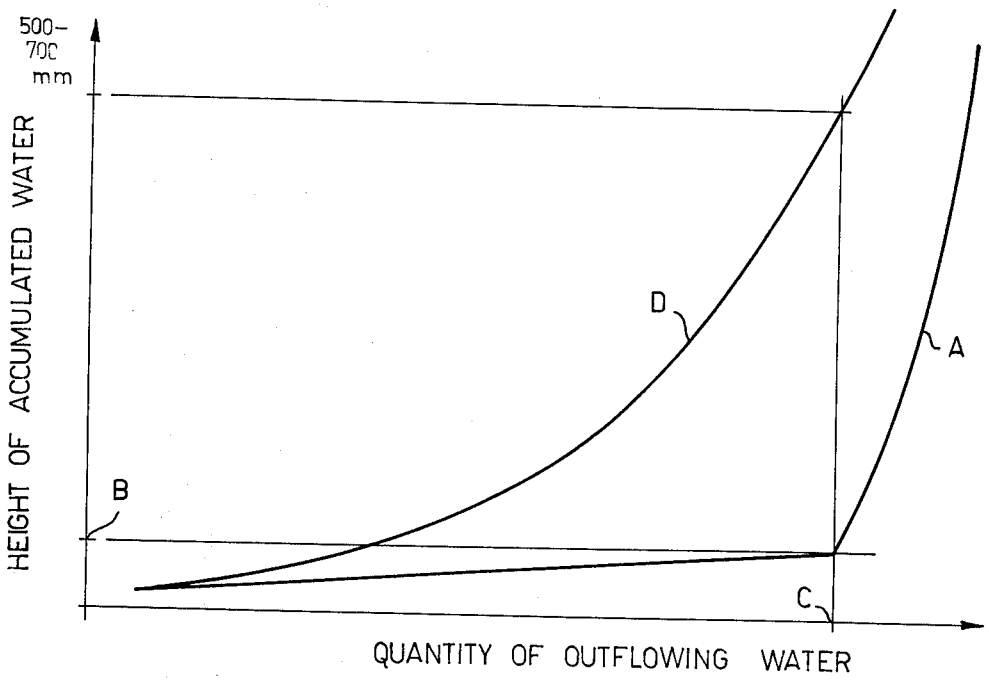

The present invention relates to a rain water roof outlet or similar for a building, comprising a vertical pipe leading from a roof or some other collecting area, a trough connected to the upper end of said pipe said trough being wider than the mouth of said pipe and having the free upper edge located at a higher level than the mouth of the vertical pipe, and a lid fastened above the mouth, said lid being wider than the mouth but smaller than the trough and the lower edge thereof being located at a lower level than the upper edge of the trough so that the lid prevents the formation of an air whirl in the vertical pipe when the trough is filled with water.

By means of such a construction of the roof outlet, there are provided at the mouth of the vertical pipe such conditions that the flow of water in the vertical pipe takes place as an airless flow, i.e. as a solid water flow across the entire cross-section of the pipe, whereby the diameter of the vertical pipe can be dimensioned essentially smaller for a specific rain water quantity to be discharged per unit of time than in conventional rain water roof outlets. When the water level in the trough is located above the lid, the pipe is completely filled with water. The prevention of entrance of air into the pipe is of decisive importance due to the fact that the specific weight of the water flowing in the pipe must be kept close to 1.0 in order that the total difference in height from the roof well to the discharge point would be in accordance with the weight of airless water and thus available for pressure losses in the conduit and in the roof well, in the bends etc. and, accordingly, would correspond to the dimensioning theory. The prevention of entrance of air is important also for the reason that water containing air bubbles takes up a bigger volume than airless water and, with the same flow of water, produces a bigger resistance than airless water.

German patent publication 568,171 describes a rain water conduit, where a circular disc is arranged in a trough above the mouth of a vertical pipe. The disc probably serves to shape the flow of water which is apparent from the shape thereof and the provision of curved guide ribs on the bottom of the trough. A number of holes extending through the disc are formed therein, as clearly appears from both figures in the patent publication.

By measuring from the drawing in the German patent and assuming that the perforation continues also in the unsectioned portion of the disc in the same way as in the sectioned portion, it can be established that the total area of the holes in the disc with respect to the cross-sectional area of the vertical pipe and the diameters of the individual holes in said disc with respect to the diameter of the vertical pipe are so big that the disc is unable to prevent air from entering through the disc in such quantities that an air whirl is produced in the mouth of the vertical pipe. No conditions for a solid flow are therefore accomplished in the German rain water roof outlet.

It is the object of the present invention to provide a rain water roof outlet which not only makes it possible to remove water in a solid flow, but which offers certain advantages to be described in more detail in the following as compared to roof outlets known hitherto. This object is achieved by means of a roof outlet according to the invention, which is characterized in that the lid portion located above the mouth of the vertical pipe is provided with a perforation known per se, the area of said perforation being so small, maximum 15 percent of the cross-sectional area of the vertical pipe, that the formation of an air whirl in the vertical pipe is prevented in spite of the air entering the mouth through said perforation.

Experiments made have proved that the access of small air quantities along with the water into the vertical pipe is allowable without disturbing the solid flow of water in said vertical pipe. The air entering through the perforation in the lid instead effectively dampens the vibration phenomena as well as the noise caused by the flow of water from the roof well to the discharge point.

Figure 2:
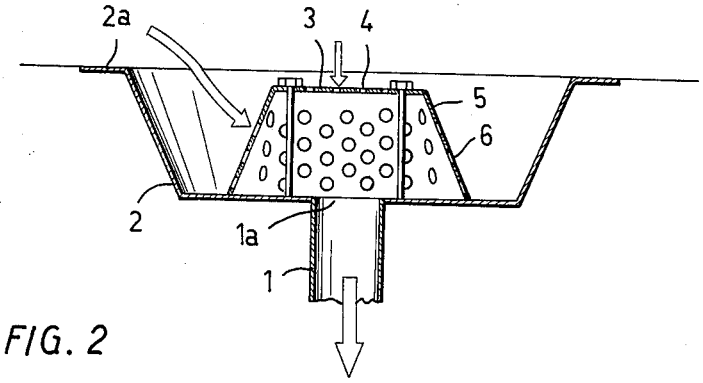

The invention will be described in more detail in the following with reference to the accompanying drawing, where FIG. 1 is a diagram illustrating the accumulation of water as a function of the water quantity in a solid flow and in a normal whirl flow, and FIG. 2 is a vertical section of one embodiment of a roof outlet according to the invention.

The curve A in FIG. 1 illustrates the accumulation of water as a function of the water quantity flowing through the vertical pipe of the roof outlet, whereby the accumulation is defined by the height of the water layer measured from the mouth of the vertical pipe. In the diagram, the distance B on the vertical axis represents the height of the lid in the roof outlet above the mouth of the vertical pipe. The lid portion located above the mouth of the vertical pipe is completely unperforated, while the lid portion located vertically at the side of the mouth is made as a perforated sieve. When the outflowing water quantity is less than the specific water quantity C for which the roof outlet is dimensioned, air is carried away into the pipe along with the water because the trough in the roof well is not yet full of water and a portion of the sieve perforation, accordingly, is open. When the flow of water into the roof outlet is smaller than the normal outflow through the pipe, i.e. when the water level in the trough remains below the closed portion of the lid, air is carried away in a vibrationlike manner and, as a result, the flow of water is retarded, the inside of the sieve is filled with water, the holes in the sieve are closed and air ceases to be carried away, whereafter the flow is again accelerated, the phenomen is repeated and a disturbing noise is produced. When the flow of water into the roof outlet increases and reaches the water quantity C for which the outlet is dimensioned, all holes in the sieve are under the water level, air ceases to be carried away and water starts to flow out as a solid flow. If the water quantity is still increased, the accumulation rapidly grows because an additional pressure height is required for the increased flow losses caused by the increased water quantity.

Curve D shows the same situation, when the roof outlet is without the lid located above the mouth of the vertical pipe. The result according to curve D follows from the fact that plenty of air is carried away into the pipe from the very beginning of the flow, much more than with a corresponding water quantity in the roof outlet described above and provided with a closed lid, and the specific weight of the outflowing water is far below 1.0. When the accumulation grows, i.e. when the flow of water into the outlet increases, the length of the cavity produced by the air whirl in the trough and in the vertical pipe increases and the entrance of air is hampered until, with a very big accumulation of approximately 500 to 700 mm, the water layer in the trough is thick enough to suppress the air whirl and the outflow of water occurs as a solid flow.

If the top portion of the lid is provided with an appropriately disposed perforation, air can be admitted uniformly through the perforation into the outflowing water and the outflow of water through the vertical pipe can be accomplished with less vibration, yet without preventing the solid flow at water quantities around the water quantity C for which the outlet is dimensioned.

In FIG. 2, there is shown a roof outlet provided with such a perforation. The outlet comprises a vertical pipe 1, leading from a roof or some other collecting area. The upper end of the pipe is connected to a trough 2 which is wider than the mouth 1*a* of the pipe. The free upper edge 2*a* of the trough is located at a higher level than the mouth of the vertical pipe. Above the mouth there is fastened a lid 3 which is wider than the mouth but smaller than the trough and which in this case consists of a circular plane disc. The lid is provided with a plurality of small through holes 4. A sieve portion 5 is connected to the edges of the lid, said portion being provided with a plurality of bigger holes 6. As can be seen from the figures, the lid is located at a lower level than the upper edge of the trough.

It has been established experimentally that, when using several holes 4 in the lid 3, the total area of the holes can be approximately 15 percent of the cross-sectional area of the pipe, and yet the flow of water through the vertical pipe occurs as a solid flow in spite of the small amounts of air allowed to enter into the vertical pipe at water quantities approaching the specific water quantity C for which the roof outlet is dimensioned. So small quantities of air do not essentially affect the solid flow.

The bigger the total area of the holes 4 is and the more disadvantageously they are disposed, the closer to curve D will the corresponding curve be positioned. The bigger the area of the individual holes is in relation to the cross-sectional area of the pipe, the closer to curve D will said curve be positioned.

If the area of the perforation is kept constant, less air is admitted to enter if there are several holes, i.e. one big hole is less advantageous than several holes having the same area. In addition, less air is carried away, the lower the holes are located in relation to the edges of the trough or the deeper the entire lid and thus also the holes are positioned in the trough.

The water flow rate in a hole in the lid has a decisive effect on the length of the cavity caused by the air whirl produced in the water in the trough. A smaller hole in the lid causes a bigger relative flow resistance than a big hole. As a pressure difference in the trough exists from the outside of the sieve through the sieve to the inside thereof, the flow rate in a small hole in the lid is smaller than in a big hole, and therefore a small hole causes a shorter vertical cavity, thereby preventing the access of air into the vertical pipe even when the water layer is thin. On the other hand, the viscosity of air is much lower than that of water, wherefore a relatively small perforation admits enough air uniformly into the water and dampens the vibration phenomen and noise.

The drawing and the associated specification are only intended to illustrate the idea of the invention. In details, the roof outlet according to the invention may vary considerably within the scope of the claims.

What we claim is:

1. A rain water roof outlet for a building, comprising a vertical pipe having a mouth at its upper end, said pipe leading from a roof or some other collecting area, a trough connected to and in communication with the upper end of said pipe, said trough being wider than the mouth of said pipe and having the free upper edge located at a higher level than the mouth of the vertical pipe, and a lid fastened above the mouth so as to leave a space between the lid and the mouth through which water can flow from the trough into the mouth, said lid being wider than the mouth but smaller than the trough and the lower edge thereof being located at a lower level than the upper edge of the trough so that the lid prevents the formation of an air whirl in the vertical pipe when the trough is filled with water, characterized in that the lid portion located above the mouth of the vertical pipe is provided with a perforation the total area of which is so small, maximum 15 percent of the cross-sectional area of the vertical pipe, that the formation of an air whirl in the vertical pipe is prevented in spite of the air entering the mouth through said perforation.

* * * * *